US005996915A

United States Patent [19]

Cordonnier et al.

[11] Patent Number: 5,996,915

[45] Date of Patent: Dec. 7, 1999

[54] VIBRATING CONE CRUSHER

[75] Inventors: Alain Cordonnier, Lille; Renaud Evrard, Lacelles; Jean-François Andre, La Riviére, all of France

[73] Assignee: FCB Societe Anonyme, Montreuil, France

[21] Appl. No.: 08/973,827

[22] PCT Filed: Jun. 11, 1996

[86] PCT No.: PCT/FR96/00879

§ 371 Date: Apr. 6, 1998

§ 102(e) Date: Apr. 6, 1998

[87] PCT Pub. No.: WO96/41680

PCT Pub. Date: Dec. 27, 1996

[30] Foreign Application Priority Data

Jun. 13, 1995 [FR] France ..... 95 06964

[51] Int. Cl.[6] ..... B02C 2/04

[52] U.S. Cl. ..... 241/207; 241/210; 241/211

[58] Field of Search ..... 241/207, 241, 241/211, 212, 213, 216, 208, 215

[56] References Cited

U.S. PATENT DOCUMENTS

| | | | |
|---|---|---|---|
| 4,452,401 | 6/1984 | Zarogatsky et al. | 241/207 |
| 5,570,850 | 11/1996 | Kay | 241/207 |
| 5,575,428 | 11/1996 | Cordonnier et al. | 241/30 |

FOREIGN PATENT DOCUMENTS

| | | |
|---|---|---|
| 2687080 | 8/1993 | France . |
| 94/21380 | 9/1994 | WIPO . |

*Primary Examiner*—John M. Husar
*Attorney, Agent, or Firm*—Harrison & Egbert

[57] ABSTRACT

A vibrating cone crusher which crushes material between a cone and a frustoconical ring located therearound. An annular frame supports the ring and a device for generating circular vibrations in a horizontal plane. Tie rods connect the frame to a cone holder. Vertical vibration that disrupts crusher operation is reduced or neutralized by positioning the center of gravity of the cone, the cone holder, the frame, and items supported thereon adjacent the plane of vibratory forces.

11 Claims, 2 Drawing Sheets

VIBRATING CONE CRUSHER

VIBRATING CONE CRUSHER

1. Technical Field

The present invention relates to vibrating cone crushers in which the material is crushed between a cone and a frusto-conical ring surrounding the cone, the axes of the cone and of the ring being vertical, and which include an annular frame bearing the ring, which is fixed in the central opening in the frame, and a device suitable for generating circular vibrations in a horizontal plane, a support for the cone, and several tie bolts connecting the frame and the cone support, the links between, on one hand, the ends of the tie bolts and, on the other hand, the frame and the cone support, respectively, being designed to allow horizontal relative movements of the frame and of the support; the assembly constituted by the frame, the members that it bears, the cone and its support rest on a bedplate or on the ground via elastic members: springs or rubber shock absorbing pads.

2. Background Art

It has been found that, in these crushers, the vibrating device, constituted, for example, by shafts with imbalance masses, or imbalance shafts, having vertical axes, generates not only horizontal vibrations of the frame bearing the ring, and of the cone support, when the crusher is in operation, but also vertical vibrations, the amplitude of which increases from the center towards the periphery of the crusher. These vertical vibrations have the harmful effects of changing the flow of materials in the grinding chamber, and of setting up stresses that are prejudicial to the mechanical strength of the crusher components, these stresses, due to the vertical accelerations, being all the greater the larger the crusher; such vertical vibrations can also be transmitted to the baseplate or to the foundations, which is inconvenient, and sometimes even dangerous. These vibrations also make the process unstable (low-frequency pulsations in the flow rate and of power consumption) through the effect of coupling between the flow of the materials into the chamber and the vertical vibrations.

The object of the present invention is to remove these drawbacks by suppressing, or at least substantially reducing, the vertical vibrations that perturb the operation of the crushers.

SUMMARY OF THE INVENTION

The crusher according to the present invention is characterised in that the center of gravity of the assembly constituted by the frame and the members that it supports and the center of gravity of the cone and its support are in the plane of the vibration forces generated by the vibrating device or in the vicinity thereof, More precisely, these centers of gravity must remain permanently within a fictitious sphere centered on the point defined by the intersection of the vertical axis of the cone with the plane of action of the vibration forces when the apparatus is idle, and having a diameter equal to 15% of the maximum diameter of the cone. By satisfying this condition, it is possible to avoid exerting upon the frame bearing the ring and upon the cone support tilting torques generating vertical vibrations.

According to one preferred form of embodiment, the frame comprises a skirt surrounding the support of the cone and possibly provided with weights, and a weighted cap is fixed on the apex of the cone. The elastic members supporting the crusher can be interposed between the bottom of the skirt and the bedplate or the foundations, the cone support being suspended from the frame by means of the through bolts. Other elastic members can be placed between the skirt and the support of the cone, or between the latter and the bedplate or the foundations.

Alternatively, the elastic members supporting the crusher can be placed between the cone support and the bedplate or the foundations, the other elastic members being placed between the skirt and the cone support.

The cone is mounted rotatably on a vertical shaft fitted into its support. To enable the height of the cone to be adjusted, it can be mounted rotatably, via bearings, on a sleeve mounted on the shaft in such a way as to be able to slide along it. Preferably, the shaft and the sleeve will have shoulders, a sealed or tight annular chamber being provided between the two shoulders and a channel pierced in the shaft to enable a liquid under pressure to be brought into the chamber to raise the cone or to be discharged in order to allow the cone to move back down.

The frame can be constituted by a bottomless tank or vessel in which the ring is held by suitable means and which is provided with an annular base on which the vibrating device is mounted, the skirt being fixed by its upper end to the edge of the base. The vibrating device will advantageously be constituted by imbalance shafts having vertical axes mounted on the base, each shaft comprising two imbalance masses disposed on either side of the base in such a way that the vibration forces generated by the rotation of the shafts are in a horizontal plane coinciding with the median plane of the base or in the vicinity thereof. It can comprise a phase shifting device constituted by a rotary jack the body or the rotary element of which will be coupled directly to one of the imbalance shafts, at least one other imbalance shaft being coupled to the rotary element or to the body of the jack, respectively, by a pulley and belt drive system.

BRIEF DESCRIPTION OF THE DRAWINGS

The following description refers to the accompanying drawings which show, by way of a non-limitative example, a form of embodiment of the invention, and in which.

DETAILED DESCRIPTION OF THE INVENTION

Figure 1:
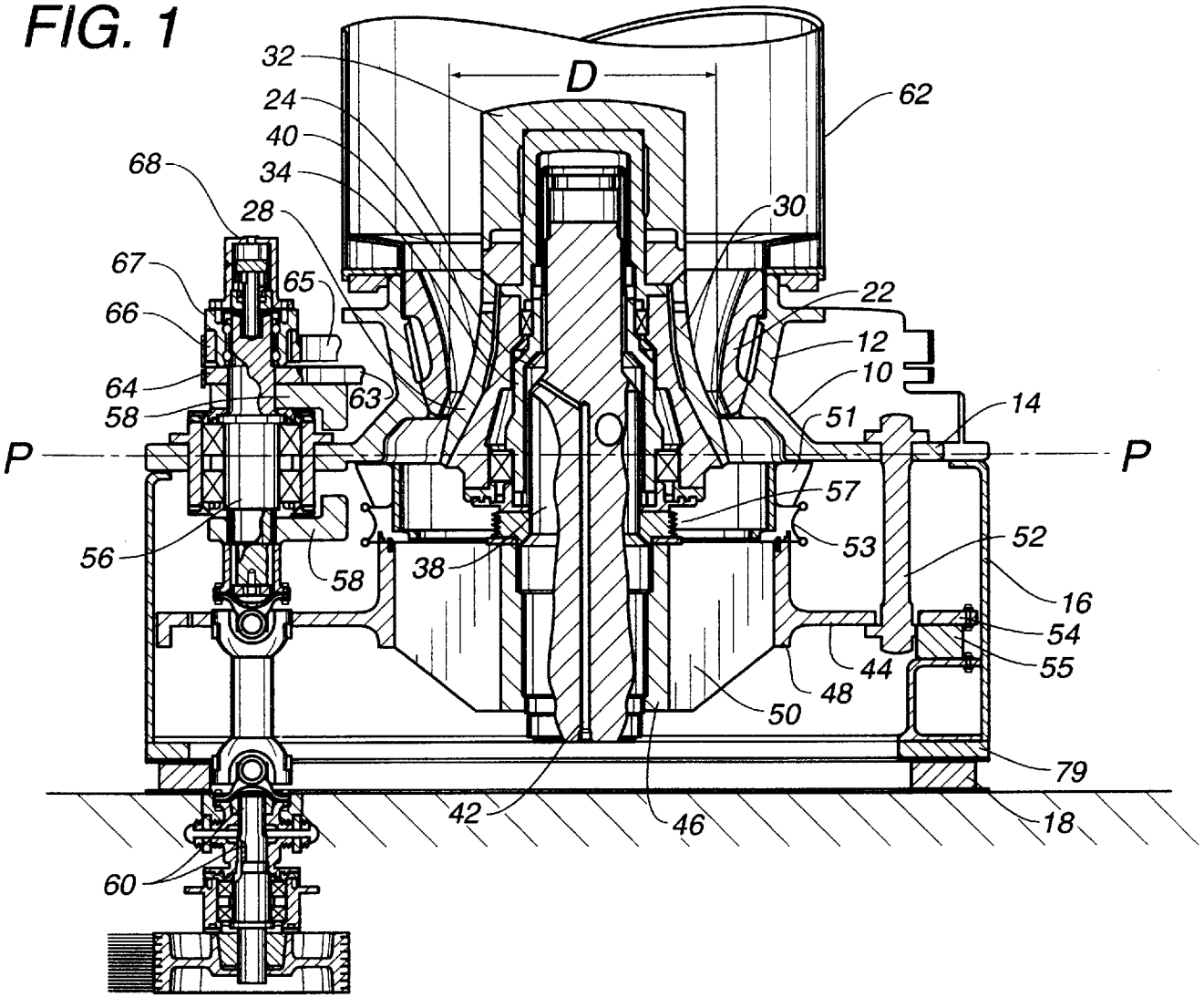
FIG. 1 is a vertical cross-sectional view of a vibrating cone type crusher designed according to the invention.

The crusher shown in FIG. 1 has a frame 10 constituted by a bottomless tank or vessel 12, having a circular cross-section and a vertical axis, provided with a base 14, and by a skirt 16 fixed underneath the base, at the edge thereof. The skirt rests on the foundations via rubber shock absorbing pads 18, which support the crusher. Weights 79 can be fixed beneath the skirt.

A ring 22 is mounted coaxially inside the vessel. It constitutes an interchangeable wearing part which is held in the vessel by a flange and bolts.

The so-called cone element, 24, which co-operates with ring 22 is, in fact, constituted by a wearing part 28 having the general shape of a cone trunk with a variable slope, mounted on a support 30 of the same shape and held thereon by a flange and screws; it is surmounted by a cap 32.

The cone is mounted on a shouldered sleeve 34 via antifriction bearings so as to be able to rotate freely about its axis. Sleeve 34 is, itself, mounted slidably on a shouldered shaft 38. The vertical axis common to the cone, the sleeve and the shaft coincides with the axis of ring 22 when the crusher is idle.

Seals are placed between the sleeve and the shaft, above and below the shoulders, so that a tight chamber 40 is formed between the latter. A channel 42, pierced in the shaft, enables this chamber to be connected to a source of liquid under pressure. By admitting liquid into the chamber or by discharging it therefrom, the heightwise position of the cone in relation to the ring, and, consequently, the grain size of the crushed product, is modified.

Support 44 of the cone is constituted by a hub 46 into which shaft 38 is fitted and a shell 48, connected to the hub by vertical ribs 50; the space provided between the hub and the shell permits the discharge of the crushed materials. It is suspended from frame 10 via connecting rods or tie bolts 52, the ends of which are connected by links to base 14 of the frame and to an annular plate 54 integral with shell 48. Only one tie bolt has been shown in the drawing but it is obvious that the crusher has several tie bolts, four for example, regularly distributed about the crusher axis. Plate 54 is further connected to skirt 16 by rubber shock absorbing pads 55, which take up at least a part of the weight of the cone and of its support. Tightness between frame 10 and cone support 44 is ensured by a metallic skirt 51 and a deformable seal 53. Tightness between support 44 and sleeve 34 is ensured by a deformable seal 57.

The crusher vibrating device is constituted by several vertical imbalance shafts 56 mounted on frame 10; only one of them is shown in the drawing. Each shaft 56 is mounted on base 14 via antifriction bearings and comprises two imbalance masses 58 disposed on either side of the base; thanks to this arrangement, the forces exerted by the imbalance masses on frame 10, when shafts 56 are rotated, are located in a horizontal plane P—P which is very close to the median plane of the base and could coincide therewith.

One of the imbalance shafts is coupled, via a double universal joint type extension, to a drive shaft 60; the other imbalance shafts are driven from the first one by a mechanical pulley and belt drive system in which is incorporated a phase shifting device for adjusting the angular displacement or shift of one group of imbalance shafts in relation to the others to change the amplitude of the resultant of the centrifugal forces generated by the rotation of the imbalance shafts. Such a system is disclosed in documents FR-A-2681080 and WO-A-9421380.

In one form of embodiment described by way of example, the crusher comprises four vertical imbalance shafts disposed at the corners of a square, as described in document WO-A-9421380. The imbalance shaft diagonally opposed to imbalance shaft 56 directly coupled to drive shaft 60 is rotated by means of a belt 63 running over pulleys 64 keyed to these two imbalance shafts, and over return pulleys mounted idle on the other two imbalance shafts. The latter are rotated by means of a second belt, 65, running over two pulleys keyed to these shafts, over a pulley 66 keyed to a sleeve 67 integral with the body of a rotary jack 68 mounted on shaft 56, and over a return pulley mounted idle on the fourth imbalance shaft.

Figure 2:
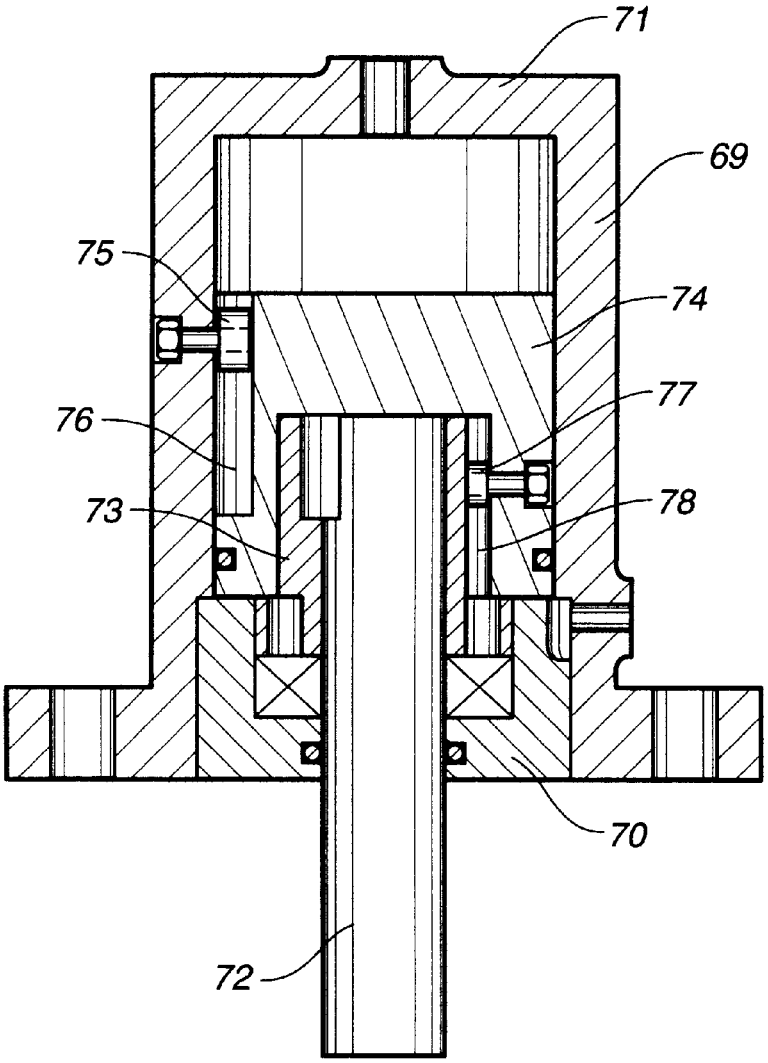
FIG. 2 is a cross-sectional view of a rotary jack constituting the phase shifting device of the vibration generating system.

The rotary jack shown in FIG. 2 comprises a cylindrical body 69 closed at its ends by end portions 70 and 71. A shaft 72 is disposed axially in the body of the jack; it passes through end portion 70 in which it is mounted via a bearing which is capable of taking up the axial stresses to which the shaft may be subjected to prevent its axial movement in relation to the body of the jack.

A socket 73 is keyed to the shaft. A piston 74 is mounted in the body of the jack; it comprises a skirt housed between the wall of the jack body and socket 73. A roller 75, mounted on a pin fixed on the body of the jack, is received in a helical groove 76 machined on the piston in such a way that any axial displacement of the piston in the body of the jack is accompanied by a rotation of the piston in relation to the latter. Similarly, a roller 77, mounted on a pin fixed on the skirt of the piston, is housed in a helical groove 78 machined in the socket, in such a way that any axial displacement of the piston in the body of the jack causes shaft 72 to rotate. The directions of grooves 76 and 78 are chosen so that the rotations of the piston and of the shaft add together. By admitting fluid under pressure into one or the other of the jack chambers, shaft 72 is caused to rotate in one direction or the other in relation to the body of the jack. Seals are mounted on the piston and on the shaft at the point where it passes through end portion 70.

Instead of using a roller and a helical groove to transform the translational movements of the piston into rotational movements, helical teeth could be machined on the piston and the shaft, these teeth engaging with toothed wheels fixed to the body of the jack and the skirt of the piston, respectively.

The body of the jack is fixed to the sleeve 67 and the outer end of the shaft is fitted into a hole in shaft 56 and keyed thereto.

The jack is supplied with oil under pressure via rotary joint and through a three-position valve which enables one or the other of the chambers to be supplied to rotate shaft 72 in one direction or the other, and to isolate the two chambers by maintaining pressurised oil therein to prevent any rotation of the shaft in relation to the jack body and to make it integral with the latter.

In operation, with the valve in locked position (jack chambers isolated), all the imbalance shafts are rotated at the same speed, and the amplitude of the resulting vibration force depends on the relative angular positions of the imbalance shafts. To modify this amplitude, the valve is actuated to cause shaft 72 of the jack to rotate, which causes relative rotation of the two shafts of one group in relation to those of the other; this adjustment can be made while in operation.

A feed hopper 62 is fixed to vessel 12.

The different parts of the crusher are dimensioned so that the center of gravity of the assembly formed by frame 10 and the members that it supports, in particular ring 22 and imbalance shafts 56, and the center of gravity of the cone 24 and of its support 44 are located in the plane of the vibration forces P—P, or in the immediate vicinity of the said plane. It is, In particular, by suitably choosing the dimensions and the weight of skirt 16, weights 79 and cap 32 that this condition is satisfied. More precisely, these centers of gravity remain within a virtual sphere centered on the 0 point defined by the intersection of the vertical axis of the cone and plane P—P when the apparatus is idle, and the diameter of which is equal to 15% of the maximum diameter D of the cone, for all crusher operating conditions. As explained earlier, this arrangement makes it possible to eliminate the tilting torques and, consequently, the vertical vibrations. It should be noted that the maximum diameter D is that of the useful part of the cone, that is to say of the part that is effectively used for crushing purposes. As can be seen from FIG. 1, the cone can be extended downwards by a part having a diameter greater than D which must not be taken into consideration.

Other arrangements could be made to support the crusher. The cone support could, for example, be caused to rest on the ground or the foundations, via shock absorbing elastic pads, with the frame and its load resting either directly on the ground or the foundations, as in the form of embodiment described above, or on the cone support, via pads analogous to pads 18 or 55.

We claim:

1. A vibrating crusher comprising:

a cone;

a ring surrounding said cone, said cone and said ring each having a vertical axis;

an annular frame bearing said ring;

a means of generating circular vibrations in a horizontal plane;

a cone support supporting said cone;

a plurality of tie bolts connecting said annular frame to said cone support, said plurality of tie bolts having respective connections with said annular frame and said cone support adapted to permit horizontal relative movements of said annular frame and of said cone support; and a plurality of elastic members adapted to support said annular frame on an underlying surface, said annular frame and said cone and said cone support each having a center of gravity located in said horizontal plane of said means of generating circular vibrations or located within a space defined by two parallel planes at a distance from said horizontal plane equal to ±15% of a maximum diameter of said cone.

2. The crusher according to claim 1, wherein said centers of gravity are within a sphere the center of which is located at a point defined by an intersection of the vertical axis of the cone and of the horizontal plane when the crusher is idle and a diameter of the sphere is equal to 15% of the maximum diameter of the cone.

3. The crusher according to claim 1 wherein the annular frame comprises a skirt surrounding the cone support, said elastic members being placed between the bottom of the skirt and the underlying surface.

4. The crusher according to claim 1 wherein the annular frame comprises a skirt surrounding the cone support, said elastic members being placed between said cone support and the underlying surface.

5. The crusher according to claim 3 wherein other elastic members connect the cone support to the skirt.

6. The crusher according to claim 1, wherein a weighted cap is fixed to an apex of the cone.

7. The crusher according to claim 3 wherein the skirt is provided with weights.

8. The crusher according to claim 1, wherein the cone is mounted rotatably on a vertical shaft fixed to the cone support, the cone being mounted via bearings on a shouldered sleeve adapted to slide along the vertical shaft, the shaft having a shoulder arranged such that a tight chamber is formed inside the sleeve between the shoulder of the shaft and of the sleeve, a channel being formed in the shaft and adapted to supply said chamber with pressurized liquid.

9. The crusher according to claim 1, wherein the annular frame is constituted by a bottomless vessel, the ring being fixed therein, said annular frame further comprising:

a base on which is mounted the means for generating; and a skirt fixed at an upper end thereof on an edge of the base.

10. The crusher according to claim 9, wherein the means for generating is constituted by unbalanced shafts each having a vertical axis, each shaft bears two imbalanced weights disposed on either side of the base in such a way that the vibration forces generated by a rotation of the unbalanced shafts are located in a horizontal plane coinciding with or adjacent to a median plane of the base.

11. The crusher according to claim 1, wherein the means for generating is constituted by imbalance shafts having vertical axes coupled to one another and to a motor by a mechanical drive system in which is incorporated a phase shifting device, said phase shifting device comprising a rotary element coupled directly to one of the imbalance shafts, at least one other imbalance shaft being coupled to the rotary element or to the body of the jack, respectively, by a pulley and belt drive system.

* * * * *